United States Patent [19]

von Hein

[11] Patent Number: 4,565,359

[45] Date of Patent: Jan. 21, 1986

[54] FOLDING APPARATUS FOR A WEB-FED ROTARY PRINTING PRESS

[75] Inventor: Eduard von Hein, Bern, Switzerland

[73] Assignee: Maschinenfabrik WIFAG, Switzerland

[21] Appl. No.: 636,318

[22] Filed: Jul. 30, 1984

[30] Foreign Application Priority Data

Jul. 27, 1983 [SE] Sweden ..... 8304156

[51] Int. Cl.[4] ..... B41L 43/04

[52] U.S. Cl. ..... 270/41; 271/184; 198/377

[58] Field of Search ..... 270/41, 45, 8, 12, 16; 271/DIG. 2, 5, 6, 184–185; 198/377, 379, 410, 413, 604, 612

[56] References Cited

U.S. PATENT DOCUMENTS

| | | | |
|---|---|---|---|
| 3,587,824 | 6/1971 | Rochla | 198/377 |
| 3,809,214 | 5/1974 | Reist | 271/185 X |
| 3,988,019 | 10/1976 | Achelpohl | 271/184 X |
| 4,020,616 | 5/1977 | Nakajima et al. | 493/419 |
| 4,387,890 | 6/1983 | Lampe | 271/184 |

FOREIGN PATENT DOCUMENTS

| | | | |
|---|---|---|---|
| 1259251 | 1/1968 | Fed. Rep. of Germany | 271/185 |
| 3124640 | 1/1983 | Fed. Rep. of Germany | 270/45 |
| 710868 | 6/1954 | United Kingdom | 493/437 |

*Primary Examiner*—E. H. Eickholt

*Attorney, Agent, or Firm*—McGlew and Tuttle

[57] ABSTRACT

To be able to produce an accurate second lengthwise fold on printed copies delivered by a web-fed rotary printing press, a second group of folding cylinders is provided downstream of a first group of folding cylinders, with the axes of all cylinders of both groups being parallel to each other. A conveying mechanism is provided between the two cylinder groups, which is equipped with turning devices by which the printed copies transferred from the first cylinder group by means of strip lines are nipped and turned through 90°. Further strip lines are provided for transferring the turned copies to the second group line of folding cylinders.

7 Claims, 3 Drawing Figures

FOLDING APPARATUS FOR A WEB-FED ROTARY PRINTING PRESS

FIELD BACKGROUND OF THE INVENTION

This invention relates in general to rotary printing presses and in particular to a folding apparatus for a web-fed rotary printing press which includes first and second spaced apart folding cylinders with a conveying device between the cylinders which includes at least one turning device which is engageable with each printed copy.

The second longitudinal fold on copies delivered by a web-fed rotary printing press was hitherto produced, in a manner known for a very long time, by means of a so-called knife folder, such as disclosed in German OS No. 31 24 640, for example.

The folding accuracy attainable with such knife folders substantially depends on the paper quality, the number of pages of the copies, and the format, and no longer satisfies today's requirements on quality, particularly not with the usual high output capacity.

SUMMARY OF THE INVENTION

The invention is directed to a folding apparatus in which the above-mentioned factors affecting the accuracy are virtually ineffective and with which an increased folding accuracy can be obtained.

In accordance with the invention a device for producing accurate second lengthwise folds on a printed copy which is delivered by a rotary printing press includes first and second spaced apart groups of folding cylinders with a conveying device between the groups which includes at least one turning device which forms a nip engageable with each printed copy.

Accordingly, it is an object of the invention to provide an improved turning device for use with rotary printing presses and which includes the rotary head which is carried by a plunger having a cam which engages on a cam track so that the plunger is moved to effect turning of the rotary head after each printed copy is engaged.

A further object of the invention is to provide an apparatus for turning printed copies in a rotary printing press which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
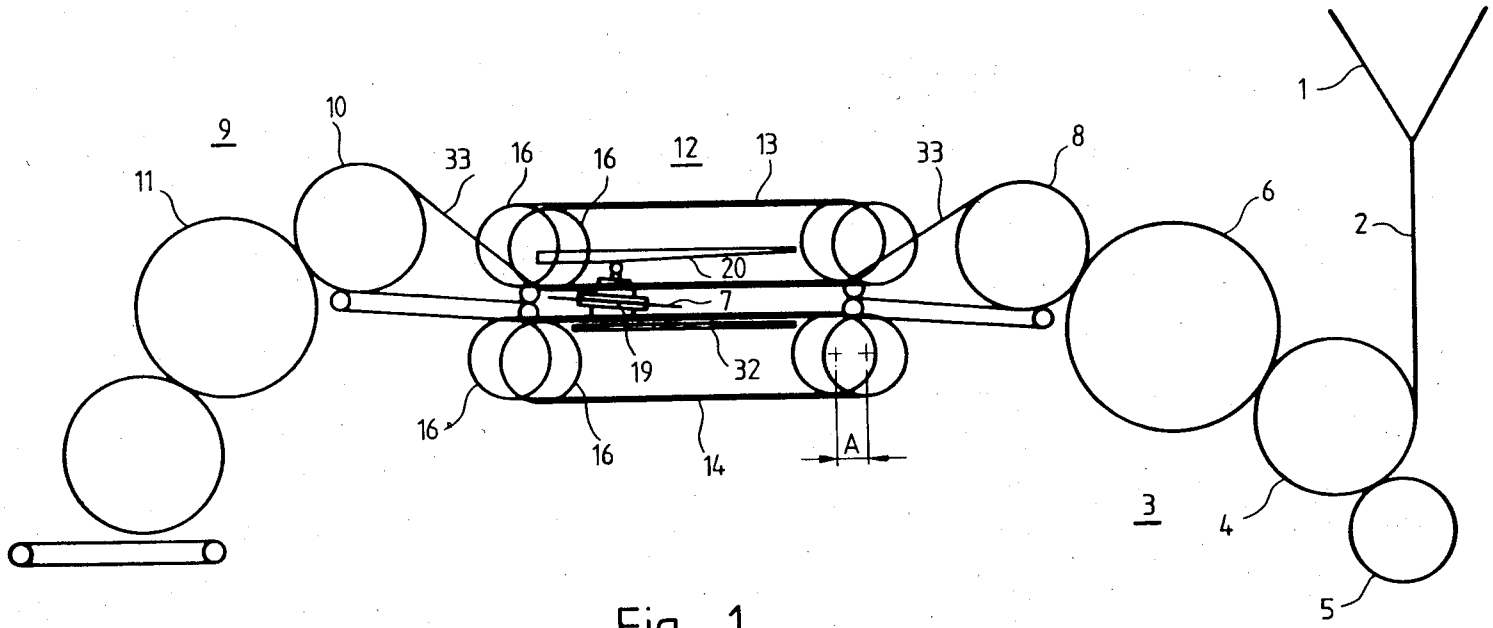
FIG. 1 is a diagrammatical side view of a folding apparatus constructed in accordance with the invention.
Figure 2:
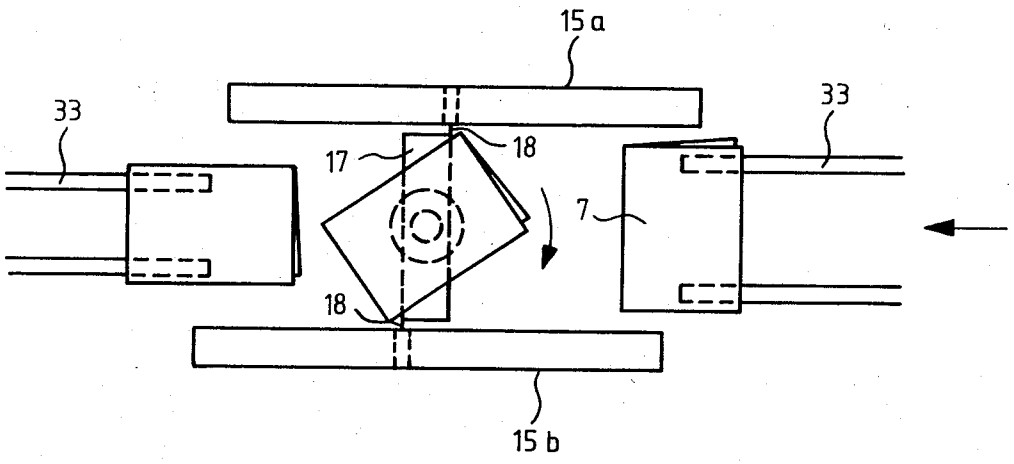
FIG. 2 is a diagrammatical top plan view of the conveying mechanism.
Figure 3:
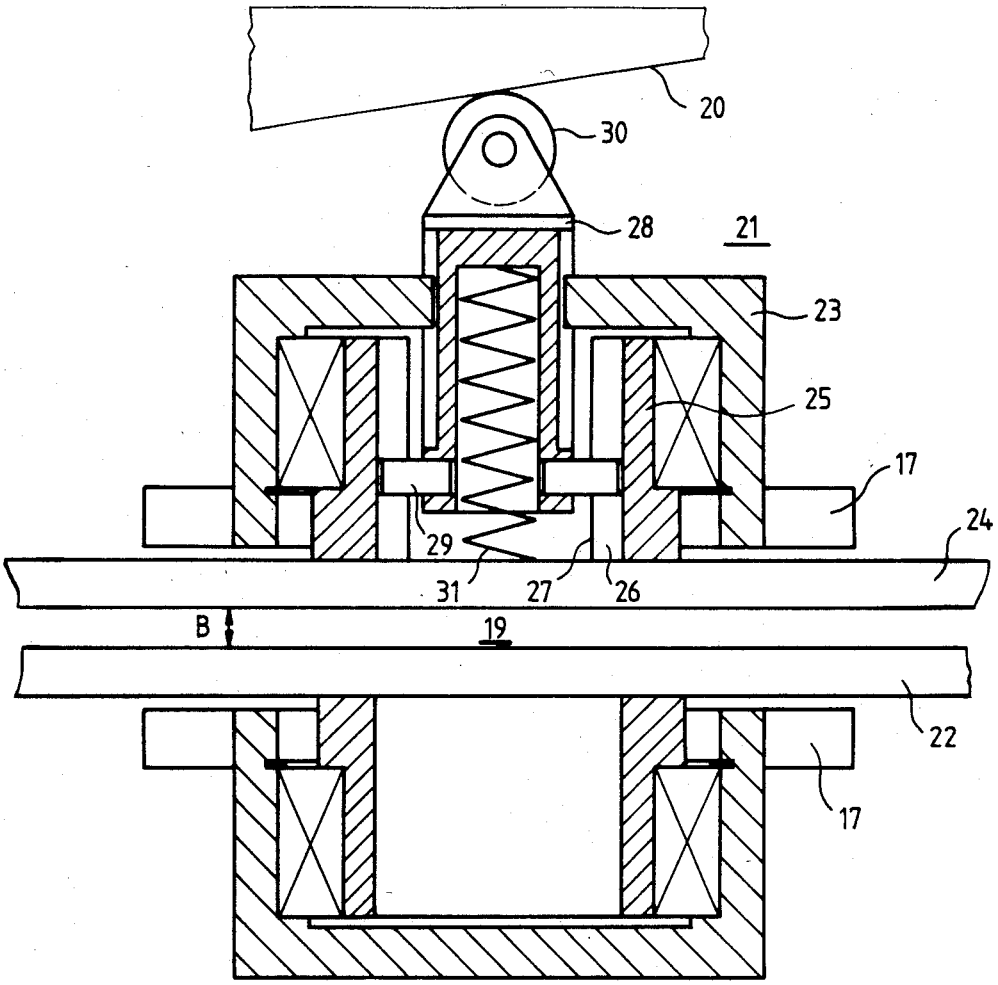
FIG. 3 is a sectional view of the turning device.

Referring to FIG. 1, a web 2 which has been folded lengthwise in a former 1 is fed to a first group 3 of folding cylinders. Group 3 comprises, for example, in a manner known per se, a collecting cylinder 4, a knife cylinder 5, and a jaw folding cylinder 6. The cylinder 6 is associated with a well known gripper cylinder 8 for removing and braking the transversely folded printed copies 7.

To produce the second longitudinal fold, a second group 9 of folding cylinders is provided having their axes parallel to the first group 3 and again comprising known elements such as the gripper and knife cylinder 10, and the jaw folding cylinder 11.

Between the first and the second groups of folding cylinders 3 and 9, a conveying mechanism 12 is provided comprising two conveying assemblies 13, 14 which are mounted above one another. Each of the conveying assemblies 13 and 14 comprises two endless conveyors 15*a*, 15*b* drivable without slippage, such as cog belts, etc., and trained about return pulleys 16. The axes of pulleys 16 of one conveyor of the assembly are offset in the conveyance direction relative to the pulley axes of the other conveyor by a distance A. The two conveyors 15*a*, 15*b* of each of the assemblies 13 and 14 are connected to each other by at least one, preferably more, transoms 17. The transoms 17 are hinged to the conveyors by which they are carried at locations 18 which are offset in the conveyance direction by the distance A. The relative positions of the return pulleys 16 and of hinge points 18 insures that transoms 17 remain in a constant position relative to the horizontal during the entire cycle of motion of the conveyors.

Every two pairs of transoms 17, moving in synchronism, are equipped with a turning device 19 comprising a rotary head 21 which is connected to the transom 17 of one of the conveyor assemblies 13 and actuable by means of a cam track 20, and a swivel plate 22 which is mounted for free rotation on the transom 17 of the other conveyor assembly.

In the shown embodiment, rotary head 21 comprises a housing 23 which is firmly secured to transom 17. Mounted in a manner known per se for rotation in housing 23 is a hub 25 to which a rotary plate 24 is secured. Hub 25 has a bore 27 with two helical grooves 26 engaged by drivers 29 which are carried by a plunger 28 which is mounted for displacement in housing 23, but secured against rotation. As a roller 30 mounted on plunger 28 comes into contact with a cam track 20, the plunger is pushed downwardly, in the direction of rotary plate 24, and drivers 29 turn hub 25 and thus rotary plate 24 through an angle of up to 90°. To ensure a turning through this angle, cam track 20 is adjustable by means known per se. As soon as roller 30 disengages from cam track 20, plunger 28 is returned to its initial position by a compression spring 31.

To ensure a proper nipping of conveyed copies 7, means which are known per se are provided for adjusting the position in height of one of the two conveyor assemblies 13, 14 so as to adjust the distance B to the thickness of copies 7.

In a preferred embodiment, all the turning devices 19 are mounted in a position which is slightly inclined relative to the direction of conveyance. This is to prevent the respective copy 7 just being turned from being obstructed by the preceeding or following copy, since turning devices 19 may follow each other very closely.

To make sure that the copies 7 will be held securely clamped in turning devices 19, the forwardly offset conveyor of conveyor assembly 14 supporting swivel plates 22 is slidably backed up by a fixed base 32.

For transferring the copies 7 to the conveying mechanism 12, as well as therefrom to knife cylinder 10 of the second group 9 of folding cylinders, strip lines 33, well known in the art, are provided.

While a specific embodiment of the invention has been shown and described in detail to illustrate the application of the principles of the invention, it will be understood that the invention may be embodied otherwise without departing from such principles.

What is claimed is:

1. A device for producing an accurate second lengthwise fold on a printed copy delivered by a web-fed rotary press which includes first and second groups of spaced apart folding cylinders, comprising a conveying mechanism between said first and second groups of cylinders having at least one turning device forming a nip engageable with each printed copy and being turnable to turn each copy up to 90 about an axis which is perpendicular to a plane containing the copy as it is fed between said groups, said conveying mechanism includes first and second conveyor assemblies mounted one above the other, each of the conveyor assemblies comprising two spaced apart endless conveyor elements which are drivable in a slip-free manner and are trained around return pulleys and including at least one transom interconnecting said spaced apart endless conveyor elements, the return pulleys over which the conveyor elements are guided being offset in a conveying direction relatively and wherein said transoms being hinged to said conveyor elements in a manner such that during an entire cyclic travel they do not change their position relative to the horizontal, a transom of each conveyor assembly carrying said turning device between said conveyor assemblies.

2. A device according to claim 1, including a first group of folding cylinders, and a second group of folding cylinders spaced from said first group and including strip lines extending between said first group and said conveying mechanism and said second group and said conveying mechanism for stripping the printed copies from the first group and delivering to said conveying mechanism and for stripping the turned copies from said conveying mechanism and delivering it to said second grroup.

3. A device according to claim 1, wherein said turning devices comprises a swivel plate connected to said transom of one of said conveyor assemblies, and a rotary head connected to said transom of the other conveyor assembly, a cam track disposed alongside said rotary head and plunger actuable by said track and connected to said swivel plate for turning said swivel plate.

4. A device according to claim 3, wherein one of said conveyor assemblies is offset in a feed direction relative to the other and a swivel plate supported on said conveyor assembly and including a backing plate backing said swivel plate which is supported on said conveyor assembly.

5. A device according to claim 3, wherein said turning device is mounted so as to be inclined in a direction in which the copies are conveyed.

6. A device according to claim 3, wherein to permit nipping of the copies, swivel plates are provided one above the other and wherein said rotary heads have plates which are adjustable relative to said swivel plates.

7. A device according to claim 6, wherein said first group of folding cylinders includes a jaw cylinder, and a gripper cylinder associated with said jaw cylinder which rotates at a reduced circumferential speed relative thereto including a take off operated by said gripper cylinder to brake the printed copies.

* * * * *